US008236114B2

(12) United States Patent
Gangl

(10) Patent No.: US 8,236,114 B2
(45) Date of Patent: Aug. 7, 2012

(54) METHOD AND SYSTEM FOR PLACING A CORNER REINFORCEMENT INSERT IN A GYPSUM BOARD CORNER ASSEMBLY

(76) Inventor: Josef Gangl, Haiming in Tirol (AT)

( * ) Notice: Subject to any disclaimer, the term of this patent is extended or adjusted under 35 U.S.C. 154(b) by 278 days.

(21) Appl. No.: 12/703,443

(22) Filed: Feb. 10, 2010

(65) Prior Publication Data

US 2011/0192519 A1 Aug. 11, 2011

(51) Int. Cl.

| | |
|---|---|
| ***B29C 65/00*** | (2006.01) |
| ***B32B 1/00*** | (2006.01) |
| ***B32B 29/00*** | (2006.01) |
| ***B32B 37/00*** | (2006.01) |
| ***E04B 2/00*** | (2006.01) |
| ***E04C 2/00*** | (2006.01) |

(52) U.S. Cl. ..... 156/40; 52/287.1; 52/631

(58) Field of Classification Search ..... 156/40; 52/287.1, 631

See application file for complete search history.

(56) References Cited

U.S. PATENT DOCUMENTS

2003/0150190 A1* 8/2003 Schroth ..... 52/794.1

FOREIGN PATENT DOCUMENTS

| | | | |
|---|---|---|---|
| EP | 0849415 B1 | | 6/2004 |
| JP | 2002030784 A | * | 1/2002 |
| WO | 2008122063 A1 | | 10/2008 |

* cited by examiner

*Primary Examiner* — Michael Orlando

(74) *Attorney, Agent, or Firm* — Laurence A. Greenberg; Werner H. Stemer; Ralph E. Locher

(57) ABSTRACT

A gypsum board corner assembly is formed with an integrated reinforcement strip. The strip may be a folded sheet-metal strip or a thin rod. First, a gypsum board is formed with a groove that extends substantially through the entire gypsum core, but leaves the laminate paper of one side. Then a reinforcement insert is placed in the groove. Here, the insert is formed of or includes ferromagnetic material. The insert is subjected to a magnetic field to pull the insert into the groove, by action of the magnet. After an amount of adhesive is applied in the groove, the gypsum board is folded along the groove while the insert is being pulled into the groove by the magnet. The resulting gypsum board corner assembly has a very accurately placed insert that defines a straight corner edge thereof.

9 Claims, 3 Drawing Sheets

METHOD AND SYSTEM FOR PLACING A CORNER REINFORCEMENT INSERT IN A GYPSUM BOARD CORNER ASSEMBLY

BACKGROUND OF THE INVENTION

Field of the Invention

The invention relates to gypsum board processing and installation. More specifically, the invention pertains to a method and a device for placing a metallic corner reinforcement at or in a corner of a gypsum board.

Gypsum boards or drywall sheets are increasingly popular building materials for interior construction. They typically consist of a pressed core of gypsum and a heavy paper laminate on either side. The boards come in different sizes and thicknesses. The most popular sized gypsum boards used in U.S. interior construction have thicknesses of ½ inch, ⅝ inches, or ¾ inches and they come in 4 ft.×8 ft. or 4 ft.×10 ft. plates.

Corners or other sharp edges must be reinforced prior to final processing, that is, before joint compound, plaster, and paint are applied. It is thereby possible to first mount the boards in place and then affix a corner sheet-metal strip, which then is covered by joint compound. It is also possible, to undercut the gypsum board, place a reinforcement rod in the undercut, and then form the corner between the two board halves, with the reinforcement rod remaining in and defining the corner.

Such a process is described in our earlier, published international patent application WO 2008/122063 A1, which is herewith incorporated by reference in its entirety. There, an undercut is formed in a gypsum board with a rotating milling cutter. The main V-shaped groove cut has an angle of 90° and it reaches through the entire gypsum core, but leaves the paper laminate on the opposite side. The main V-shaped cut is formed with an elliptical undercut which, when the partial boards are folded towards one another along the V-shaped groove, form a substantially cylindrical void as the board assumes a 90° corner. Prior to folding the partial boards, a reinforcement rod is placed into the groove. The rod then assumes its position in the cylindrical void when the boards are glued in the 90° angle position and the rod forms the reinforcement of the corner.

As the partial boards are folded towards one another, the reinforcement rod may be displaced and pushed backwards. This is entirely unacceptable because the corner no longer has a straight appearance and the reinforcement property is lost. It is imperative, in the context, to ensure that the reinforcement rod does not deviate from its proper corner position during folding and gluing, because it is imperative that the corner be absolutely straight.

It is also important in some contexts, to provide for relatively sharp corners. For that purpose, it is advantageous to integrate reinforcement rods with an increasingly small diameter. I have found, however, that processing with rods having a diameter of, say, 4 mm and less becomes virtually impossible.

BRIEF SUMMARY OF THE INVENTION

It is accordingly an object of the invention to provide a method and device for placing a corner reinforcement structure in a drywall corner, which overcomes the above-mentioned disadvantages of the heretofore-known devices and methods of this general type and which ensures proper placement and permanent alignment of the reinforcement strip in such corner structures.

With the foregoing and other objects in view there is provided, in accordance with the invention, a method of forming a reinforced gypsum board corner. The method comprises the following steps:

providing a gypsum board with a groove extending substantially through an entire gypsum core thereof;

placing an insert in the groove, the insert being formed of or with a ferromagnetic material;

subjecting the insert to a magnetic field and pulling the insert into the groove, by action of the magnet; and folding the gypsum board along the groove while the insert is being pulled into the groove by the magnet, to thereby form a gypsum board corner with the insert defining a reinforcement of a corner edge thereof.

In accordance with an added feature of the invention, the groove is formed substantially with a V-shape having sidewalls enclosing an angle supplementary with an angle of the corner to be formed. The term supplementary means that the two angles add up to 180°.

In accordance with an added feature of the invention, the groove is formed with an undercut substantially corresponding to a shape of the insert when the gypsum board is folded along the groove and the corner is formed.

In accordance with an added feature of the invention, an amount of adhesive is placed into the groove prior to or concurrently with the folding step.

With the above and other objects in view, there is also provided, in accordance with the invention, a system for producing a reinforced gypsum board corner assembly. The gypsum board is placed on a work table surface, a groove (with or without an undercut) is formed in the gypsum board with a milling tool, a reinforcement strip is placed in the groove. In accordance with the improvement proposed herein, there is provided a magnet to attract the reinforcement strip and pull the strip into the groove while the gypsum board is being folded along the groove. The reinforcement strip defines a corner of the gypsum board corner after the gypsum board has been folded along the groove.

In accordance with an added feature of the invention, the magnet is a permanent magnet inset into the worktable surface and it may be in the form of a single strip, a full-surface cover, or in the form of a plurality of pods. In the alternative, the magnet is an electrical magnet inset into the worktable surface, and a control unit (simply a switch, or a system allowing adjustment of the magnetic field intensity) is connected to the magnet for driving said magnet.

In accordance with a concomitant feature of the invention, the table with the magnet(s) is covered by a magnet-permeable protective surface cover.

Other features which are considered as characteristic for the invention are set forth in the appended claims.

Although the invention is illustrated and described herein as embodied in a method and device for placing a corner reinforcement structure in a gypsum board corner, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF A PREFERRED EMBODIMENT OF THE INVENTION

Figure 1:
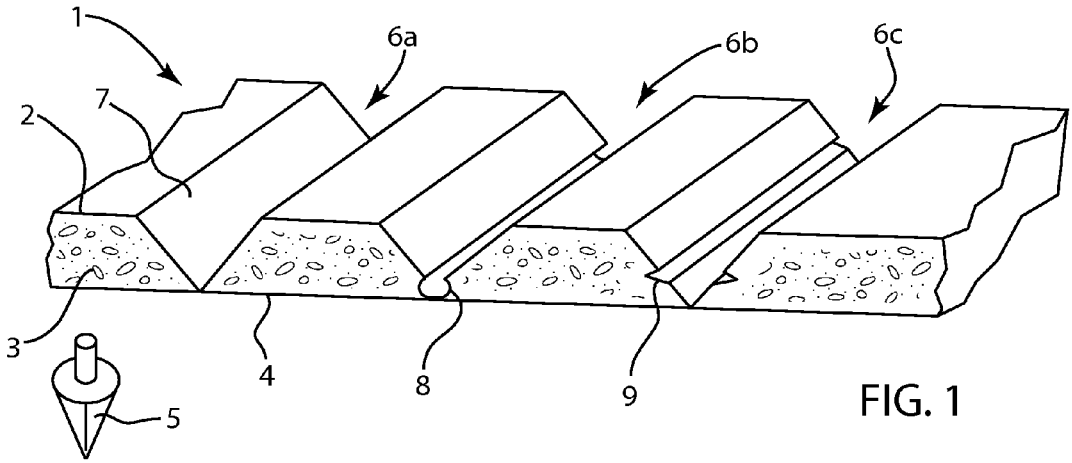
FIG. 1 is a perspective view of a gypsum board with three exemplary groove cuts.

Referring now to the figures of the drawing in detail and first, particularly, to FIG. 1 thereof, there is seen a partial view of a gypsum board 1 with three exemplary groove cuts. Gypsum boards are also referred to as gypsum plaster board, drywall, drywall sheet, wallboard, plaster board, or sheet rock. The gypsum board 1 is a laminate of a heavy paper sheet 2, a gypsum core 3, and another heavy paper sheet 4. The entire laminate assembly has a standardized thickness. The most conventional gypsum boards are ⅝ inches thick or ¾ inches thick. The paper typically has a thickness of approx. 0.2 to 0.3 mm, or approx. 1/16 inch.

A rotary milling bit 5 is used to cut grooves 6. Here, three exemplary grooves are illustrated. Groove 6*a* is a simple 90° groove without an undercut. The angle of the groove, i.e., the angle enclosed by its sidewalls 7, is substantially supplementary to the angle of the final corner. That is, a 60° groove allows folding of the plates to a relative (outer) angle of 120°. Such angles, of course, are suitable for forming hexagons, for example. A 120° groove, on the other hand, will result in a 60° angle, which is suitable for forming triangular columns, for example. The groove is cut entirely through the core 3, so that only the laminate paper 4 remains. When the partial plates are folded towards each other along the groove 6*a*, the sidewalls 7 come to touch each other. It is thus advantageous to prepare the sidewall surfaces with a glue base prior to or during folding, so that the corner remains fixed thereafter.

A second exemplary groove 6*b* is formed with an elliptical undercut 8. This type of groove, as also shown in PCT/AT2008/000115, is suitable for a cylindrical rod reinforcement insert. When the sidewalls 7 of the groove 6*b* are folded towards one another, the undercut 8 forms a substantially cylindrical void.

A third exemplary groove 6*c* is formed with yet another type of undercut 9, formed in each of the sidewalls 7. Here, when the partial plates are folded along the groove 6*c*, the undercuts 9 meet and they form a line void along the seam formed by the sidewalls 7. The significance of this exemplary embodiment will become clear in the following description.

Figure 2A:
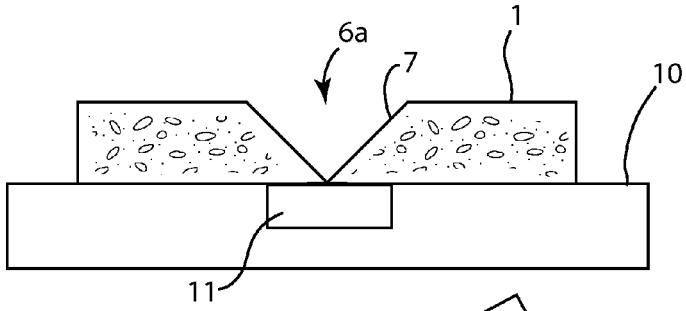
FIGS. 2A, 2B, and 2C are diagrammatic side elevations illustrating a sequence during which a reinforced corner is produced.
Figure 2B:
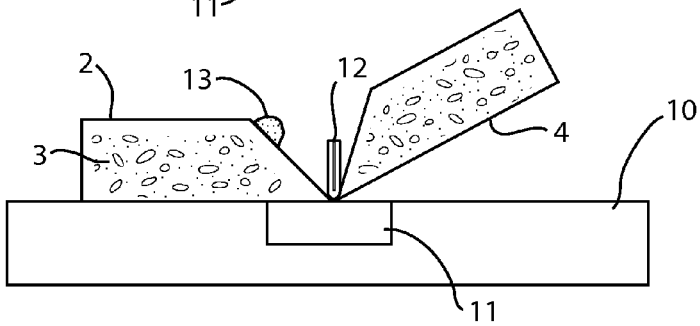
Figure 2C:
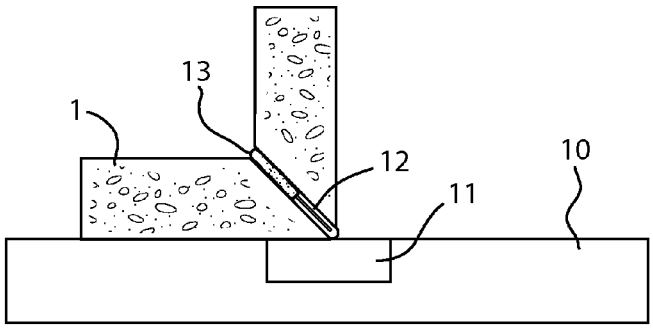

Referring now to FIGS. 2A, 2B, and 2C, there is illustrated a sequence of forming a drywall corner with a reinforced edge. The gypsum board 1 is placed on a work table 10 and a groove 6*a* is cut along a predetermined bending line. The milling tool 5 is preferably held in a rotary cutter that is freely guided horizontally and whose milling depth can be accurately adjusted. Advantageous results may be obtained by utilizing the workbench/tool assembly MAGAform 3000, available from Magacon Technologies, GmbH, of Austria. The height level of the tool can be adjusted so that the gypsum core is severed entirely and only the bottom paper 4 is retained. The table 10 has an integrated magnet 11. The magnet may be a full-surface cover, one or more strips along the entire working surface of the table 10, or it may be formed of individual (cylindrical) pods that are distributed along the line below the groove 6*a*. It is also possible, albeit less energy efficient, to dispose the magnet 11 below supporting board of the work table 10. The magnet may be a permanent magnet or an electrical magnet 11. The latter can be driven and triggered in accordance with the requirements, as will be noted in the following.

A reinforcement strip 12 is then placed into the V-shaped groove. The strip 12 is of a nature so that it will be attracted by a magnet. The reinforcement strip will typically be a ferromagnetic metallic strip or a plastic strip with ferromagnetic inlays. It may also be a hard polymer strip with integrated ferromagnetic particles. Here, we illustrate a single-fold sheet metal strip 12, whose rounded edge is placed deep into the V-shaped groove so that it comes to lie directly on the laminate paper 4. The strip 12 is formed of ferromagnetic material, so that it is attracted by the magnet 11. There is also applied a bead of glue 13 in the groove 6*a*. Alternatively, the glue 13 may cover the entire groove 6*a*, or only one side wall 7. Advantageous adhesives are, for example, a specially developed cold glue (e.g., MAGAfix construction glue available from Magacon Technologies GmbH, Austria) or a hot melt glue (e.g., MAGAfix hot glue available from Magacon Technologies GmbH, Austria). The typical sequence to be followed would be to first cut the groove, prime the groove walls with glue or sealer, place the reinforcing insert 12, apply the glue 13. The latter two steps may be reversed. Then, with the magnet active on the insert 12 and pulling it into the groove, the adhesive is allowed to set and cure slightly. Then the gypsum board 1 is folded along the groove 6*a*. At this time, the magnet 11 is active so that the insert 12 is attracted towards the magnet. The magnetic force thus assures that the reinforcement insert 12 defines an entirely even and completely straight corner. The rounding radius thereby corresponds to the rounding of the reinforcement strip 12 plus the thickness of the paper 4 (e.g., 3 mm).

The finally folded corner assembly is illustrated in FIG. 2C. Once the assembly is folded and the adhesive 13 has cured, the magnet may be turned off (if it is an electric magnet), and the corner assembly may be removed and packed for shipping. In the alternative, of course, the corner assembly may also be produced directly at the construction site and immediately used.

Figure 3A:
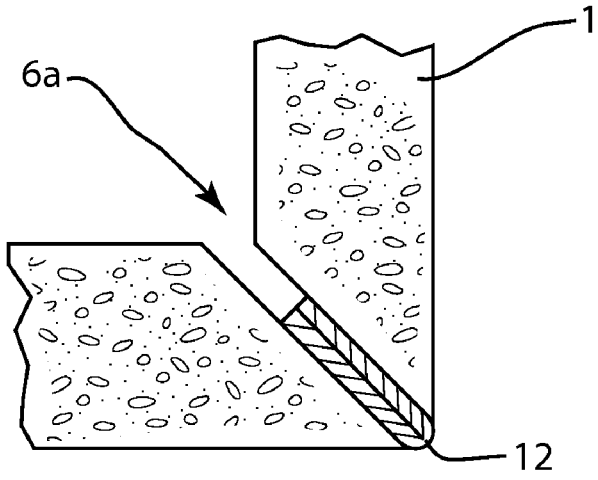
FIGS. 3A, 3B, and 3C are partial side views illustrating resulting reinforced gypsum board corners.
Figure 3B:
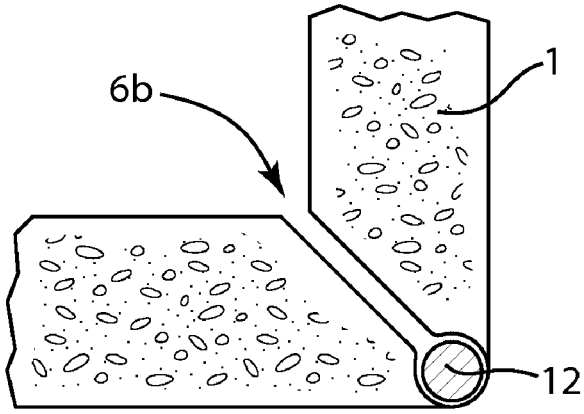
Figure 3C:
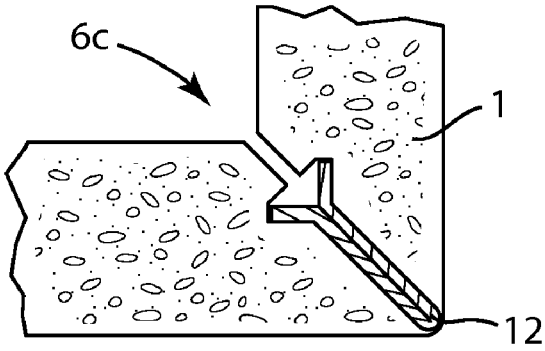

Three 90° corner assemblies, based on the grooves 6*a*, 6*b*, and 6*c*, respectively, are illustrated in FIGS. 3A, 3B, and 3C. The adhesive 13 is not illustrated here. The groove 6*a*, which is formed without an undercut, should be cut with a "dull" milling head. That is, the V-shaped groove should be formed with a rounded bottom, or with a flat bottom so that the sidewalls 7 do not meet at the paper 4. In this way, there is enough room left for the reinforcement insert 12, when the walls 7 are collapsed towards one another.

The corner assembly with the undercut groove 6*b* is illustrated in FIG. 3B. The oblong or elliptical undercut 8 results in a substantially cylindrical opening once the walls 7 are collapsed towards one another. The radius of the undercut 8 is adapted to the radius of the round insert 12. Due to the fact that the magnet 11 is used during the assembly, it is possible to use very thin reinforcement inserts 12. It is even possible to use rods with a diameter of less than 4 mm. The magnet attraction during the folding process assures that the insert 12 remains in place (i.e., it is not displaced by material vestiges, unevenly cut materials, or unevenly folding paper 4), and that the resulting corner is entirely straight and even.

Figure 4:
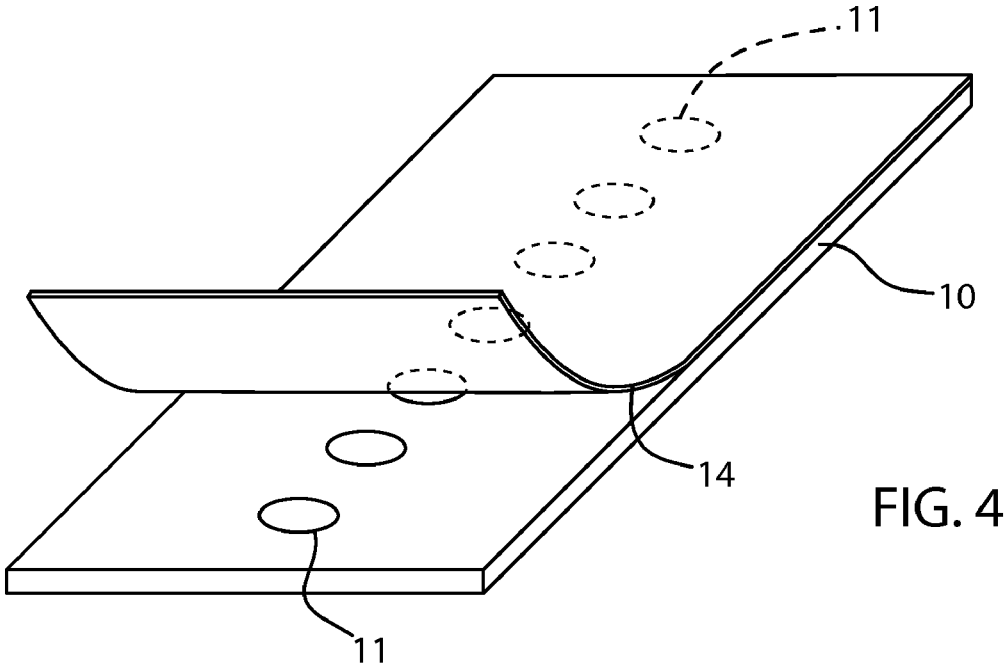
FIG. 4 is a perspective view of a work table surface according to the invention.

Referring now to FIG. 4, there is shown an exemplary work table and platform. The magnet 11 is in the form of a plurality of pot magnets that are sunk into the table plate 10 in a linear alignment. The plate 10 is formed of wood, of metal, or of a suitable plastics material. The plate 10 is covered with a protective surface cover 14, for example, PVC or the like.

Figure 5:
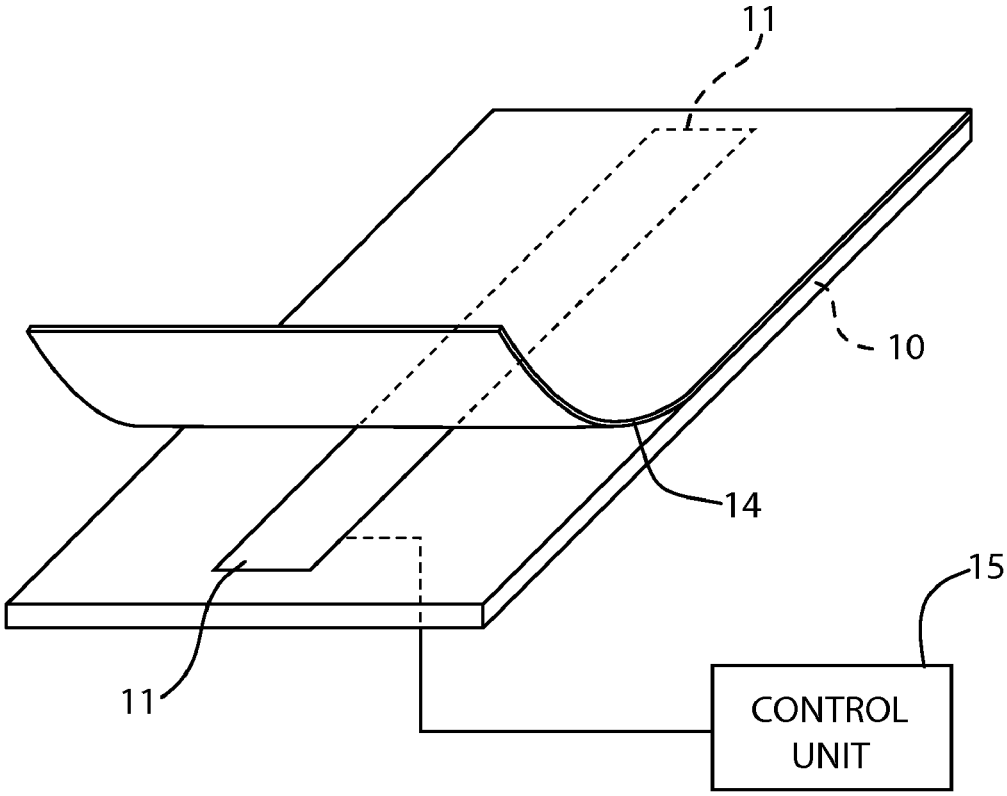
FIG. 5 is a perspective view of a further exemplary embodiment of the work table surface according to the invention.

FIG. 5 shows a similar work table 10. Here, however, the magnet 11 is a continuous strip which is integrated in a recess in the top surface—or the bottom surface—of the plate 10. FIG. 5 also shows a control unit 15 that is connected to the magnet 11 and which allows the magnet to be triggered as desired and also to adjust the strength of the magnetic field, i.e., the strength of the magnetic force pulling the insert 12 towards the table during production.

The invention claimed is:

1. A method of forming a reinforced gypsum board corner, the method which comprises:

providing a gypsum board with a groove extending substantially through an entire gypsum core thereof;

placing an insert in the groove, the insert being formed with or of a material to be attracted by a magnet;

subjecting the insert to a magnetic field and pulling the insert into the groove by action of the magnet; and folding the gypsum board along the groove while the insert is being pulled into the groove by the magnet, to thereby form a gypsum board corner with the insert defining a reinforcement of a corner edge thereof.

2. The method according to claim 1, which comprises forming the groove substantially with a V-shape having sidewalls enclosing an angle supplementary with an angle of the corner to be formed.

3. The method according to claim 1, which comprises forming the groove with an undercut substantially corresponding to a shape of the insert when the gypsum board is folded along the groove and the corner is formed.

4. The method according to claim 1, which comprises placing an amount of adhesive into the groove prior to or concurrently with the folding step.

5. The method according to claim 1, which comprises placing a ferromagnetic metallic reinforcement strip into the groove.

6. In a system for producing a reinforced gypsum board corner assembly, wherein a gypsum board is placed on a worktable surface, a groove is formed in the gypsum board with a milling tool, a reinforcement strip is placed in the groove, and the reinforcement strip defines a corner of the gypsum board corner after the gypsum board has been folded along the groove, the improvement which comprises:

a magnet disposed to attract the reinforcement strip and to pull the strip into the groove while the gypsum board is being folded along the groove.

7. The system according to claim 6, wherein said magnet is a permanent magnet inset into the worktable surface and a magnet-permeable protective surface cover is disposed to cover the magnet and the worktable surface.

8. The system according to claim 6, wherein said magnet is an electric magnet inset into the worktable surface, and wherein a control unit is connected to said magnet for driving said magnet, and a magnet-permeable protective surface cover is disposed to cover the magnet and the worktable surface.

9. The system according to claim 6, wherein said magnet is a magnetic strip formed of permanently magnetic material.

* * * * *